US008677725B2

(12) United States Patent
Zaretsky et al.

(10) Patent No.: US 8,677,725 B2
(45) Date of Patent: Mar. 25, 2014

(54) REINFORCEMENT CABLE

(75) Inventors: Lev Markovich Zaretsky, Magnitogorsk (RU); Veniamin Alexandrovich Kharitonov, Magnitogorsk (RU); Yuriy Anatolyevich Dryomin, Magnitogorsk (RU)

(73) Assignee: Limited Liability Company "Armasteel", Magnitogorsk (RU)

( * ) Notice: Subject to any disclaimer, the term of this patent is extended or adjusted under 35 U.S.C. 154(b) by 0 days.

(21) Appl. No.: 13/514,401

(22) PCT Filed: Oct. 11, 2010

(86) PCT No.: PCT/RU2010/000573

§ 371 (c)(1),
(2), (4) Date: Jun. 7, 2012

(87) PCT Pub. No.: WO2011/071410

PCT Pub. Date: Jun. 16, 2011

(65) Prior Publication Data

US 2012/0240548 A1 Sep. 27, 2012

(30) Foreign Application Priority Data

May 4, 2010 (RU) ..... 2010117661

(51) Int. Cl.
*D02G 3/44* (2006.01)

(52) U.S. Cl.
USPC ..... 57/212; 57/215; 57/219

(58) Field of Classification Search
USPC ..... 57/200, 212, 213, 215, 219
See application file for complete search history.

(56) References Cited

U.S. PATENT DOCUMENTS

| | | | | | |
|---|---|---|---|---|---|
| 945,039 | A | * | 1/1910 | Katzenstein | 57/215 |
| 1,822,219 | A | * | 9/1931 | Jenkin | 57/215 |
| 2,113,710 | A | * | 4/1938 | Riddle | 57/212 |
| 2,491,293 | A | * | 12/1949 | Zerr | 57/211 |
| 2,620,618 | A | * | 12/1952 | Chamoux | 57/215 |

(Continued)

FOREIGN PATENT DOCUMENTS

| | | |
|---|---|---|
| DE | 1 659 265 A1 | 1/1971 |
| RU | 2 245 407 C1 | 1/2005 |

(Continued)

OTHER PUBLICATIONS

Evdokimov, N.I., et al., "Tekhnologiya monolitnogo betona I zhelezobetona", Moscow, Vysshaya Shkola, 1980, pp. 1-3.

(Continued)

*Primary Examiner* — Shaun R Hurley
(74) *Attorney, Agent, or Firm* — Ladas & Parry LLP

(57) ABSTRACT

The invention pertains to the production of cables and can be used for reinforcing single-block constructions and other articles made of concrete. The purpose of the invention is to create a self-rectifying reinforcing member. The reinforcement cable comprises a central wire and layer-forming wires spirally wound around the same and having a periodical profile. A periodical profile is applied on the outer section of the surface of the layer-forming wires and is made in the form of inclined protrusions above the generatrix of the crimped surface of the cable. The sections of the surface of the layer-forming wires in contact with other wires are made in the form of spirally-arranged planar flats.

3 Claims, 2 Drawing Sheets

(56) References Cited

U.S. PATENT DOCUMENTS

| | | | | | |
|---|---|---|---|---|---|
| 3,035,403 | A * | 5/1962 | Grimes, Jr. et al. | 57/214 |
| 3,391,531 | A * | 7/1968 | Riggs | 57/217 |
| 3,538,702 | A * | 11/1970 | Wolf et al. | 57/218 |
| 3,778,993 | A * | 12/1973 | Glushko et al. | 57/215 |
| 3,861,442 | A * | 1/1975 | Bertrand | 152/540 |
| 4,244,172 | A * | 1/1981 | Glushko et al. | 57/215 |
| 4,610,122 | A | 9/1986 | De Clercq | |
| 4,627,229 | A * | 12/1986 | Bourgois | 57/213 |
| 4,628,683 | A * | 12/1986 | Bourgois et al. | 57/213 |
| 4,709,544 | A * | 12/1987 | Charvet | 57/218 |
| 4,805,393 | A * | 2/1989 | Reta | 57/248 |
| 5,090,188 | A * | 2/1992 | Lin et al. | 57/234 |
| 5,214,244 | A * | 5/1993 | Cummings et al. | 174/42 |
| 5,323,595 | A * | 6/1994 | Mizuta et al. | 57/212 |
| 5,687,557 | A * | 11/1997 | De Vos et al. | 57/214 |
| 5,878,564 | A * | 3/1999 | De Vos et al. | 57/311 |
| 6,182,432 | B1 * | 2/2001 | Takahashi | 57/200 |
| 7,114,319 | B2 * | 10/2006 | Sakonjo et al. | 57/200 |
| 7,484,545 | B2 * | 2/2009 | Westgate et al. | 152/557 |
| 7,546,724 | B2 * | 6/2009 | Wang | 57/210 |
| 8,006,475 | B2 * | 8/2011 | Aoyama | 57/212 |
| 2007/0028584 | A1 * | 2/2007 | Wang | 57/232 |
| 2009/0205308 | A1 * | 8/2009 | Aoyama | 57/212 |
| 2010/0043381 | A1 * | 2/2010 | Van Zyl | 57/215 |

FOREIGN PATENT DOCUMENTS

| | | | |
|---|---|---|---|
| RU | 2 256 755 CI | | 7/2005 |
| SU | 401790 | A1 | 10/1973 |
| SU | 1294960 | A1 | 3/1987 |

OTHER PUBLICATIONS

"Die-Rolled Section Reinforcing Weldable Rolled Products of A500S and B500S classes for Reinforcement of Ferro-Concrete Structures", Federal Agency for Technical control and Metrology, National Standard of the Russian Federation, GOST R 52544, 2006, pp. 1-20.

LTs Berinsky (M.Sc), "Steel Trihedral Strands for Prestressed Reinforced Concrete Structures", Code of Regulations SP 52-103-2007, Monolithic Ferroconcrete Constructions, p. 232-234, dated 1967.

* cited by examiner

REINFORCEMENT CABLE

RELATED APPLICATION INFORMATION

This application is a 371 of International Application PCT/RU2010/000573 filed 11 Oct. 2010 entitled "Reinforcement Cable", which was published on 16 Jun. 2011, with International Publication Number WO 2011/071414 A1, and which claims priority from Russian Patent Applications No.: 2009145244 filed 11 Dec. 2009, 2009145245 filed 11 December and 2010117661 filed 4 May 2010, the contents of which are incorporated herein by reference.

TECHNICAL FIELD

The invention relates to the production of cables, and it can be used in production of inserted reinforcements being used for reinforcing monolithic constructions and other products made of concrete.

BACKGROUND

Reinforcing steel of classes A500 and A600 comprises a hot-rolled rod having the cross section being close to a circle and inclined ribbed protrusions on its surface (see GOST K 52544-2006. Weld reinforcing rolled stock of periodical profile, Classes A500C and B500C, for reinforcing ferroconcrete structures. Engineering Specification).

The disadvantage of the known reinforcing steel is a low technological effectiveness in the manufacture of monolithic structures due to its production in the form of sections of standard length, which makes it necessary to get each reinforcing element by connecting a plurality of sections butt-to-butt by welding, which leads to weakening of each section in the weld points. Another disadvantage of the traditional reinforcing steel is its low corrosion resistance of a reinforcing structure made of it due to centers of corrosion in the place of welding, as well as the practical impossibility of using zinc anticorrosive coating because of the extremely low weldability in the case of such coating deposition. The closest analogue to the claimed article is a reinforcement cable comprising a central wire and wires winding in a spiral around said central wire with a periodic profile in the form of protrusions and depressions. At the same time the periodic profile is applied throughout the whole surface of the wound wires (see DE 1659265).

Said cable can be made in the form of a single product of an arbitrary length, and it can self-strengthen and has a mechanical engagement in the direction of screwdriving. However it does not provide the strong adhesion to concrete because of the narrow gaps between the circumference around the cross-section of the cable and the surface of the outer wires. There is no space remaining for the formation of strong ridges of concrete under the generating line of the cable. What is more, the disadvantage of the cable is in that the physical and mechanical properties do not correspond to the requirements of the embedded reinforcement due to the fact that the strength provided by the high strength of the wire is not realized in the cross-sectional dimensions which are greatly inferior to the transverse dimensions of the cross section of hot-rolled reinforcing steel of equal aggregate strength due to the relatively small contour of enveloping.

A method of reinforcing ferroconcrete structures is disclosed in prior art. Said method comprises mounting nontensioned reinforcement in the direction of the largest extension of the structures and in the transverse directions, cyclic constructing of a casing, and filling the space inside the casing with concrete, while hot-rolled rods of standard length are used as reinforcement rods connected butt-to-butt by welding or through threaded bushing after completing the cycle of the construction of the ferroconcrete element (see Code of Regulations SP 52-103-2007 "Monolithic Ferroconcrete Constructions").

The disadvantages of this method of reinforcement are low strength of the reinforcing elements, in particular low specific strength and high creeping of reinforcing rods because of the many places of connection of each reinforcement rod in length, so that a rod cannot not take the load as a single structure, and the high cost of reinforcement due to the low specific strength of reinforcing rods and high labor expenditures because of the numerous repetitive butting of the reinforcing elements.

The closest analog to the claimed method of manufacturing is a method of manufacturing reinforcement cables comprising producing wires of round cross section, forming a periodic profile on the outer wires, cabling the wires, and subsequent compressing. The periodic profile is applied to the entire surface of the wires before cabling, and after cabling the elastic compression is carried out by drawing the cable through a crimping die (see German patent DE 1659265, E 04 C 5/03).

The disadvantage of this method is it is impossible to produce a reinforcement cable with physical and mechanical properties required for insertion reinforcement due to the fact that the manufactured cable has a cross section close to a circle, which does not allow realizing its strength characteristics due to insufficient contour of enveloping. In addition, the adhesion of the cable to concrete is lower than that of a hot-rolled profiled reinforcement.

The technical problem solved by the invention is to create a self-straightening reinforcing element with an arbitrarily large length with strength characteristics and the enveloping contour of the section at the level of hot-rolled reinforcing steel of grades A500 and A600, adhesion to concrete and other characteristics not below the level of hot-rolled reinforcing steel of grades A500 and A600, as well as improved corrosion resistance due to unlimited possibility of applying anticorrosion coatings.

The problem is solved in the following way. In the prior art a reinforcement cable comprises a central wire and wires spiraling around the central wire with a periodic profile.

BRIEF SUMMARY

According to the invention, the tensile strength of the wires is two or more times higher than that of the hot-rolled reinforcement rods of the equal diameter; a periodic profile is applied in the form of inclined protrusions above the generating line of the cable compressed surface; the wire surface portions in contact with other wires are made in the form of spirally arranged flat areas; the periodic profile is applied to the outer surface area of the wound wires, and gaps between the cable section circumference and the outer wire surfaces have increased size compared to the gaps in a cable with round wires due to the shape of outer wire section and arrangement of the wires so that the tangent contour connecting outer portions of the wound wires is close to the triangle with rounded corners, but with no more than one incomplete layer, for example according to arrangement 1+6+3, arrangement 3/3 or 3+3+6+3.

The wires can also be arranged so that the tangent contour connecting the outer portions is close to a polygon with rounded angles, for example according to the arrangement 1+6+2.

The wires can also be arranged so that the tangent contour connecting the outer portions is close to a triangle or a polygon with concave sides and rounded angles, for example according to the arrangement 1+6+3 or 1+6+2.

A periodic profile can be made not on all outer wires or on all surfaces, for example, in arrangement 1+6+3 the periodic profile is on the outer surface of 6 wires of the first layer while 3 wires of the second layer have a smooth compressed surfaces.

The claimed cable can be used in the following manner. In the known method of reinforcing ferroconcrete constructions comprising mounting of nontension reinforcing in the direction of the greatest extension of the construction and in the transverse direction and cycling mounting of a casing and filling the casing with concrete, wherein according to the present invention reinforcement cables having a shaped periodical profile are used as reinforcement. Said cables are secured at a base of the construction and fixed in each cycle of filling between the earlier formed portion of the construction and a distribution template. The distribution template is fed through running rollers and a guide from the reels arranged at the base of the construction. The distribution template is shifted aside from the earlier formed portion before each filling cycle at a distance equal to the size of the formed portion with consequent unwinding of the reinforcement cable to a length which is twice the size, wherein each reinforcement element is in one piece along the whole length of the construction. Mutually perpendicular elements of the reinforcement are connected with bushings or tie wire.

The reinforcement cables can be disconnected from the reels after half of the construction length has been formed for avoiding excess length of the cable sections.

What is more, the cables of a shaped periodical profile can also be used as reinforcement in construction of small length.

Such complex of technical solutions allows using the cables as reinforcement: periodical profile excluding the effect of screwdriving makes it possible to use cables having high specific and absolute strength, high relaxation resistance and fatigue resistance. Absence of longitudinal connections makes it possible to use the reinforcement with strain hardening and provide for uniform distribution and transfer of a load to other reinforcement elements, and for use of anticorrosion coating, for example, with zinc.

High relaxation and fatigue resistance of the cable reinforcement provides for higher endurance of reinforcement structure. High specific strength allows lowering the weight of the structure, and the specific cost (in terms of strength). Decreased number of operations for connecting reinforcement elements results in lower cost.

The claimed structure of the reinforcement cable can be produced only if the claimed method for manufacturing is used, said method comprising producing wires of round cross section; forming a periodical profile of wound wires; winding said wires in a cable; and compressing the cable. According to said method the periodical profile is produced on the outer portions of the wound wire surfaces in the process of winding them into a cable by deformation directly in the point of twisting along the outer surface of the wound wires in a shaped roller tool having rollers with cylindrical or barrel-shaped working surface with inclined slits, said rollers being arranged relative the axis of the compressed cable at an angle equal to the angle of the outer surface of the cable wires to its axis, wherein at the time of forming a periodical profile, the rollers perform plastic compression of the cable and formation of spiral flat areas on the portions of contacts of the wires with each other.

The distinctive feature relating to the shape of a cable with spiral triangular section is disclosed in prior art (I. Ts. Berinsky, *Steel Triangular Strands for Stressed Ferroconcrete Constructions*, Steel Cables, recourse book, Issue 4, Kiev, Tekhnika Publishers, 1967, pages 232-235). In said solution like in the claimed one, the spiral triangular section is used for forming massive concrete protrusion under the generating line of the reinforcement element preventing any rectilinear motion of the element relative to concrete. However in the claimed invention, contrary to the citer reference, the spiral triangular section is a part of complex solutions aimed at increasing the bond of the concrete and also excluding screwdriving due to the periodical profile of the outer wire surface.

What is more, in the claimed invention one of the functions of the triangular section is increasing the diameter of the generating surface and, correspondingly, of the enveloping contour for corresponding of this parameter to the rod armature of equal strength. It should be also noted that the figures of the prior art solution show schematic views of a spiral multilayer cable section with at least two incomplete layers of wires wherein a part of the wires contact in tangential direction with a wire located on the same radius only in one direction, and correspondingly not having a support in a reverse direction.

By the virtue of such configuration, the cable shown in said solution does not secure stable fixation of wires. A wire of the outer layer under normal or tangential load inevitably moves inside to the level of the inner incomplete layer, at the same time shifting in the free space at the same or smaller radius (if there are three or more incomplete layers) one of the wires of this layer. As a result, the wire shifted to the smaller radius has an excess length, and it misses the fixed position at portions adjacent to the point of load application. As any cable is under substantial load in the process of production on a drawing capstan, it can be confidently stated that the prior art solution cannot be realized on any present cable driving machine, and it does not meet such characteristic of an invention as industrial applicability.

Contrary to that solution, in the claimed invention only one incomplete layer is formed. This layer is stable due to additional stabilizing factor of plastic compression directly in the process of winding: due to the fact that it is impossible for a wire to shift to a smaller radius completely filled by shorter wires of inner layer as well as to the same radius in another angular position since after compression the wire of the outer layer is indented in the gap between the wires of the inner layer, and the width and depth of free gaps between the wires of the inner layer are decreased due to their indent into each other, and correspondingly each wire of the outer layer after passing the point of twisting is on minimum possible radius in a stable position.

Thus, the claimed invention is industrially applicable in contrast to the prior art solution.

The distinctive feature characterizing use of the reinforcement cable for nontensioned reinforcement has not been found in prior art technical solutions.

The distinctive feature characterizing possibility to apply anticorrosion coating by excluding welded joints due to self-strengthening and flexibility of the nontensioned reinforcement with high coefficient of adhesion has not been found in prior art technical solutions.

The distinctive features characterizing the shape of the reinforcement cable for inserted reinforcement with shaped section, periodically profiled outer surface, and contact portions on the inner surface of the wound wires have not been found in prior art technical solutions.

In view of above review on the prior art sources of information, it can be concluded that the claimed reinforcement cable and the method for its manufacturing are not obvious to a person skilled in the art, and they therefore meet the patentability criterion of "inventive step".

BRIEF DESCRIPTION OF THE DRAWINGS

The invention is illustrated in the following drawings.

DETAILED DESCRIPTION

Figure 1:
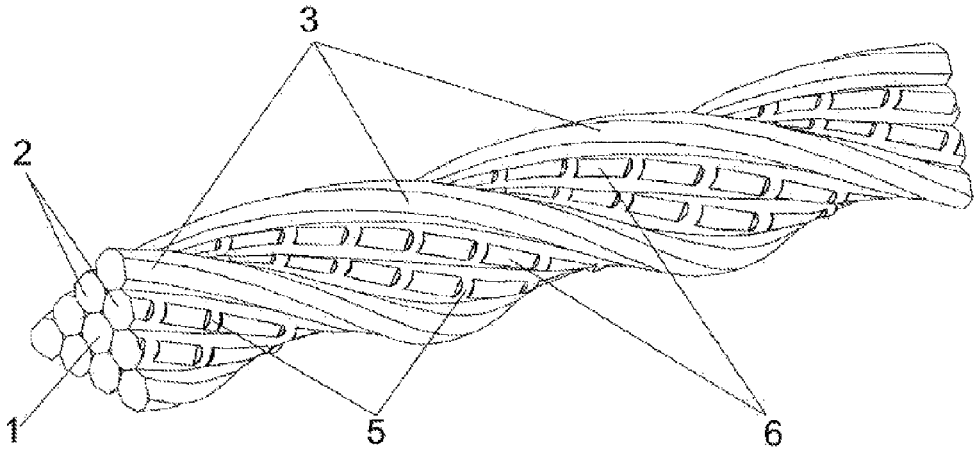
FIG. 1 is a general view of the reinforcement cable.
Figure 3:
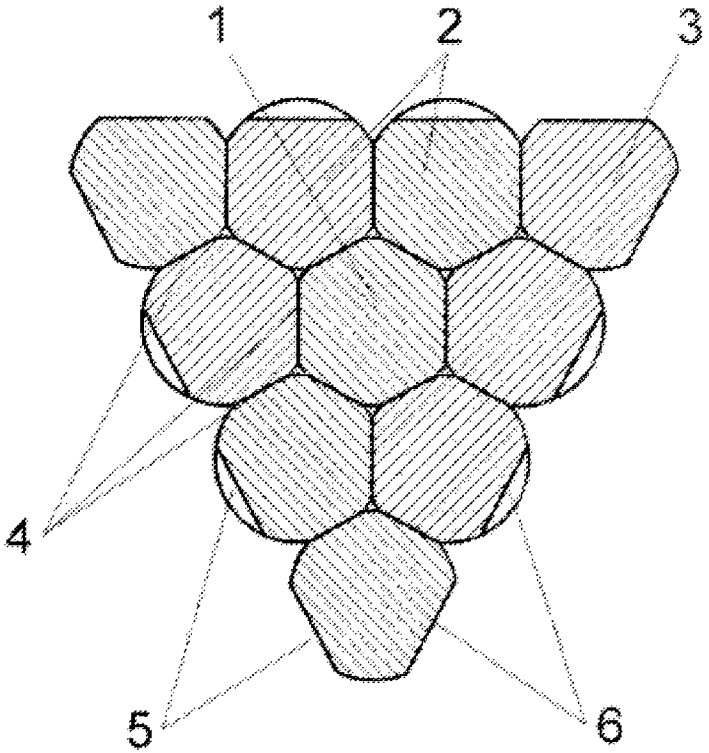
FIG. 3 is the same view as in FIG. 2 with periodical profile only on the outer surfaces of the inner layer of the wound wires.
Figure 2:
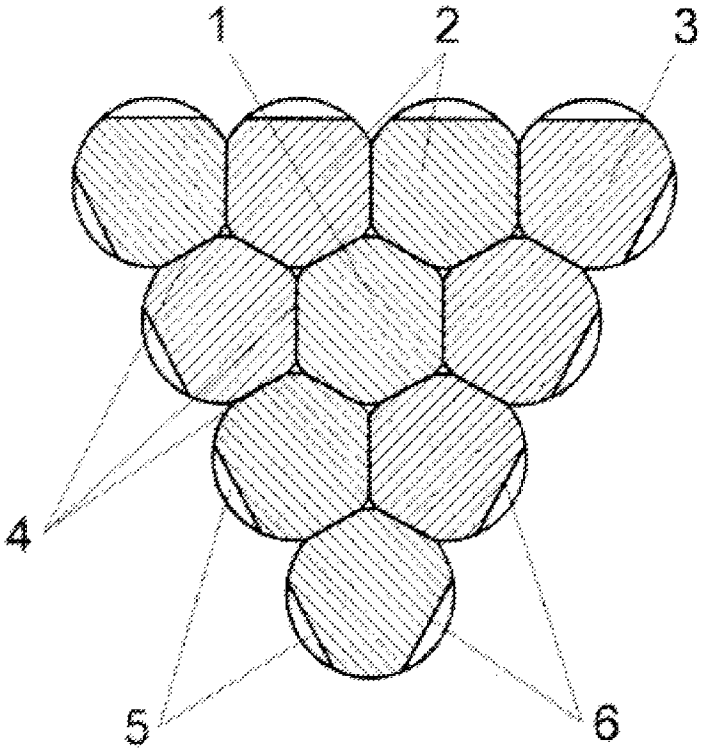
FIG. 2 is a schematic view of the cross section of the reinforcement cable having structure 1+6+3 with a periodical profile on all outer surfaces of the wound wires.

The reinforcement cable has the following structure. A rectilinear central wire 1 (FIGS. 1, 2 and 3) is arranged along the axis of the cable. Six spiral wound wires 2 of the inner layer are arranged around the central wire. They are closely fitting each other and the central wire 1. In the gaps between the wound wires 2 of the inner layer there are three wound wires 3 of the outer layer closely fitting the wound wires 2 of the inner layer and being 120 degrees apart from each other. Surface portions of the wound wires 2 and 3 contacting the surface of the central wire 1 and adjacent wound wires 2 and 3, and the portions of the central wire 1 surface contacting the wound wires 2 are in the form of spiral flat portions 4 (FIGS. 2 and 3). There is a periodical profile in the form of inclined protrusions 5 on the generating line 6 of the cable compressed surface on the outer portions of the wound wires 2 (FIGS. 1 and 2) or on the outer portions of the wound wires 2 and 3 (FIG. 3).

The claimed structure of the reinforcement cable improves its physical and mechanical properties due to uniform distribution and low level of contact tensions in the cable. At the same time the adhesion of the cable to concrete increases due to essential increase in the gaps between the circumference around the cross-section of the cable and the surface of the outer wires leaving space for forming strong ridges of concrete and the increased contour of enveloping.

For calculation of the adhesion coefficient Fr, it is taken into account that the transverse projection of each of the three cable faces at the twisting step is a closed ring having the outer radius equal to the circumscribed radius, and the inner radius is equal to the distance from the cable axis to the outer edge of area 4 of contact between two adjacent wires 2 of the inner layer.

Calculation of the ring area and its ratio to the area of a circumscribed cylinder with the height equal to the pitch of winding, the wire diameter of 3.0 mm, the finished cable circumscribed diameter of 13.6 mm, the distance from the cable axis to the outer edge of the contact portion 4 of 2.6 mm, the winding step of 80 mm, shows that the ratio is 0.105, which is substantially higher than the typical for A500 reinforcement value of 0.075. What is more, due to larger length of the gaps between the faces there is essential space for the formation of strong ridges of concrete thereby realizing the enlarged area of the crumpled cable, whereas in the case of A500 reinforcement the enlargement of the area of the crumpled reinforcement to said value leads to actial fall of adhesion due to lack of space between the profile protrusions for the formation of the concrete ridges of sufficient strength.

The apparatus for reinforcing with cables of monolithic ferroconcrete constructions can be, for example, as follows.

The base of the apparatus is a frame resting on previously formed area of the construction. Said frame consists of the uprights being, for example, telescopic (not shown) for attachment and fixation of the unit for feeding reinforcement above the level of the building under construction, and the unit of feeding the reinforcement comprising a distribution template, a set of running rollers and guides arranged between the running rollers and the reels with standard pieces of the shaped periodical cable.

The claimed method for reinforcing ferroconcrete constructions is carried out, for example, as follows: the ends of wound on reels standard elements of the shaped periodical cable are fixed at the base of the reinforced construction. The unit of feeding reinforcement is supplied and fixed by external or embedded mechanisms and fixing elements of any commonly used type. The reinforcement is fed corresponding to the size of the concrete portion formed in the cycle so that the portions of the standard elements of the shaped periodical cable positioned between the distribution template and earlier formed portion of the construction are arranged in the required direction. The reinforcement is mounted in a transversal direction, and a casing is assembled around the reinforcement. Then the casing is filled with concrete.

After a half of the construction length in the direction of reinforcement by the claimed method is built, there are the portions of standard elements of the shaped periodical profile cable between the running rollers and the reels in the guides having length sufficient for reinforcing the remaining part of the construction. Therefore the standard elements can be released from the reels and fixed in the guides using braking devices of any type known in the art.

The reinforcement cable is manufactured as follows. First, the central wire 1 and wound wires 2 and 3 of a round cross section are produced and wound in between in a cable using any known cable driving machine, for example, a machine of bow type. After winding, a periodical profile is applied to the outer parts of the wound wires 2 or 2 and 3 in the shape of inclined protrusions 5 above the generating line 6 of the surface by cold deformation along the outer surface of the outer wires of the wound cable in a closed shaped roller tool of periodical profile.

At the same time that the periodical profile is applied to the cable surface in said tool, the cable is subjected to plastic compression when the contact portions 4 are formed.

The invention claimed is:

1. A reinforcement cable comprising a central wire and spiral wires of periodical profile wound around it, wherein:

a periodical profile is designed as inclined protrusions above a generating line of the compressed surface of the cable;

wire surface areas in contact with other wires are made in the form of spirally arranged flat areas; a periodical profile is applied to an outer surface area of the wound wires; and gaps between a cable cross section circumference and the outer wire surfaces have increased size compared to the gaps in a cable with round wires due to the shape of outer wire sections and arrangement of the wires so that the tangent contour connecting the outer portions of the wound wires is close to a triangle with rounded corners, but with no more than one incomplete layer.

2. The reinforcement cable according to claim 1, wherein the wires are positioned so that the tangent contour connecting the outer portions of the wound wires is close to a polygon with rounded corners.

3. The reinforcement cable according to claim 1, wherein the wires are positions so that the tangent contour connecting the outer portions of the wound wires is close to a triangle or a polygon with rounded corners.

* * * * *

UNITED STATES PATENT AND TRADEMARK OFFICE

CERTIFICATE OF CORRECTION

PATENT NO. : 8,677,725 B2
APPLICATION NO. : 13/514401
DATED : March 25, 2014
INVENTOR(S) : Lev Markovich Zaretsky et al.

It is certified that error appears in the above-identified patent and that said Letters Patent is hereby corrected as shown below:

Title page, item (30) Foreign Application Priority Data

Please insert

--December 7, 2009 (RU) 2009145244

December 7, 2009 (RU) 2009145245--

Signed and Sealed this
First Day of July, 2014

Michelle K. Lee

Michelle K. Lee
*Deputy Director of the United States Patent and Trademark Office*